United States Patent [19]

Playe

[11] Patent Number: 4,727,386

[45] Date of Patent: Feb. 23, 1988

[54] PRINT HEAD FOR AN ELECTROSTATIC IMAGE

[75] Inventor: Patrice Playe, Houilles, France

[73] Assignee: La Telephonie Industrielle et Commerciale Telic Alcatel, Cedex, France

[21] Appl. No.: 923,928

[22] Filed: Oct. 28, 1986

[30] Foreign Application Priority Data

Oct. 28, 1985 [FR] France ..... 85 15978

[51] Int. Cl.[4] ..... G10D 15/10

[52] U.S. Cl. ..... 346/155; 346/153.1

[58] Field of Search ..... 346/139 C, 153.1, 154, 346/155, 162, 163; 400/119; 101/DIG. 13; 358/300

[56] References Cited

U.S. PATENT DOCUMENTS 4,447,821 5/1984 Yuasa et al. ..... 346/154

4,636,816 1/1987 Playe ..... 346/154

*Primary Examiner*—Arthur G. Evans

*Attorney, Agent, or Firm*—Sughrue, Mion, Zinn, Macpeak & Seas

[57] ABSTRACT

An electrostatic print head for creating a latent image on a dielectric recording medium (1) in order to enable said image to be subsequently transferred to a final medium (generally ordinary paper) after development by inking. The print head comprises a conventional multitude of electrodes (E) and associated conterelectrodes (CE) disposed in parallel rows for progressively building up an electrostatic latent image on the moving dielectric medium (1), and includes an additional rotary coupling electrode (EC) which is raised to a direct potential whose average voltage is of the same polarity as the high voltage control pulses applied to the counterelectrodes, which pulses are themselves of opposite polarity to the pulses applied to said electrodes. The coupling electrodes (EC) is pressed against the recording dielectric medium level with the electrodes and the counterelectrodes, and against the opposite side of the medium relative to said electrodes and counterelectrodes.

4 Claims, 3 Drawing Figures

PRINT HEAD FOR AN ELECTROSTATIC IMAGE

The present invention relates to a print head for printing an electrostatic image. Such an electrostatic image print head is used to build up an electrostatic latent image progressively on a moving dielectric recording medium by means of selective ion discharge.

BACKGROUND OF THE INVENTION

Direct electrostatic printing requires special paper having a conductive base covered with a thin dielectric film. An electrostatic latent image is created on the special paper by selective ion discharge in air by means of a row of small electrodes which are raised to a high tension. The latent image is linked (for example by means of a magnetic brush conveying ink powder) and then fixed on the special paper by the application of pressure and/or heat.

In order for ion discharge to take place at the tips of the electrodes and in order for the ions to be deposited on the special paper, high voltage is set up between at least one of the electrodes and at least one counterelectrode placed in the proximity thereof so that the resulting electric field at the electrode extends perpendicularly to the surface of the special paper. In a prior embodiment, the counterelectrodes are placed on the same side of the special paper as the electrodes, and the discharge takes place by virtue of the capacitive effect of the counterelectrodes through the dielectric film of the special paper and by virtue of the conductive effect of the conductive base of said special paper.

The individual electrodes used in the print head are very small and very numerous for an image line of given length, for example, electrodes may be provided to print at a pitch of eight points per millimeter.

The high voltage required for ion discharge is preferably shared between the electrodes and the counterelectrodes, and since discharge takes place only above a threshold high value, the voltage applied solely to the electrodes or solely to the counterelectrodes is taken to be too small to be capable of setting up a discharge, and thus of printing, on its own.

The electrodes are aligned along at least one row and are organized in packets, with the electrodes in the same packet and the same row being interconnected. The counterelectrodes are distributed alongside the packets.

A relatively large gap, for example 0.2 mm to 0.5 mm, is required between adjacent counterelectrodes by virtue of the values of the voltages which are to be switched. This has an unfavorable effect on the printing when high resolution is required. In spite of the conductivity of the conductive base in the special paper, the electric field falls off in zones where the electrodes are disposed opposite a gap between counterelectrodes.

This drawback can be minimized by positioning the electrodes in two networks, each comprising the same number of packets in alternation, and by using counterelectrodes whose positions are offset along the packets by half a packet's length so that they overlap two consecutive half packets, with the counterelectrodes overlapping each half of a packet being switched simultaneously.

When writing an indirect electrostatic image, the latent image is written onto a thin insulating film and is then developed by being inked in exactly the same way as described above. The developed image is then transferred to a sheet of ordinary paper and is fixed thereon, for example by pressing the sheet of paper against the inked insulating film.

Although the disposition of the electrodes which is suitable for direct electrostatic writing is also suitable for indirect electrostatic writing, the same is not generally true for the disposition of the counterelectrodes since in the indirect case neither the insulating film nor the paper are conductive.

Consequently, the conventional solution in indirect electrostatic writing consists in causing the insulating film on which the latent image is deposited to pass between facing electrodes and counterelectrodes.

However, this solution has drawbacks, related in particular to he complexity of the system for applying voltage control signals to the overall assembly, and to the need for highly accurate positioning of the counterelectrodes relative to the electrodes in spite of the fact that it is advantageous with this indirect printing solution to able to separate the electrodes and the counterelectrodes in order to insert the insulating film or to replace it each time the user needs to change film.

It is thus preferable from this point of view for the electrodes and the counterelectrodes to be located on the same side of film.

The present invention therefore proposes a print head for printing an electrostatic image on a recording medium, in particular of the ordinary paper type, in which the electrodes and the counterelectrodes required for ion discharge are disposed on the same side of the recording medium.

SUMMARY OF THE INVENTION

The present invention provides an electrostatic print head comprising firstly at least one row of individual electrodes disposed at a regular pitch and organized into n groups which are shared between two different networks, with the electrodes occupying the same positions in the various groups of a given network being interconnected, and secondly at least one set of counterelectrodes running parallel to the individual electrodes and each attributed to at least one group of the adjacent electrodes in such a manner as to create a latent image on a dielectric recording medium running over said electrodes and said counterelectrodes by ion discharge between at least one of said electrodes and at least one of said counterelectrodes respectively raised to high voltage potentials of opposite polarity by high voltage control pulses, the electrostatic print head including the improvement of a rotary coupling electrode made of a conductive material and raised to a direct potential of average voltage having the same polarity as the high voltage pulses applied to the counterelectrodes, said coupling electrode being pressed against the recording medium level with the electrodes and the counterelectrodes and on the opposite face of the recording medium to said electrodes and counterelectrodes.

BRIEF DESCRIPTION OF THE DRAWINGS

Embodiments of the invention are described by way of example with reference to the accompanying drawings, in which.

MORE DETAILED DESCRIPTION

Figure 1:
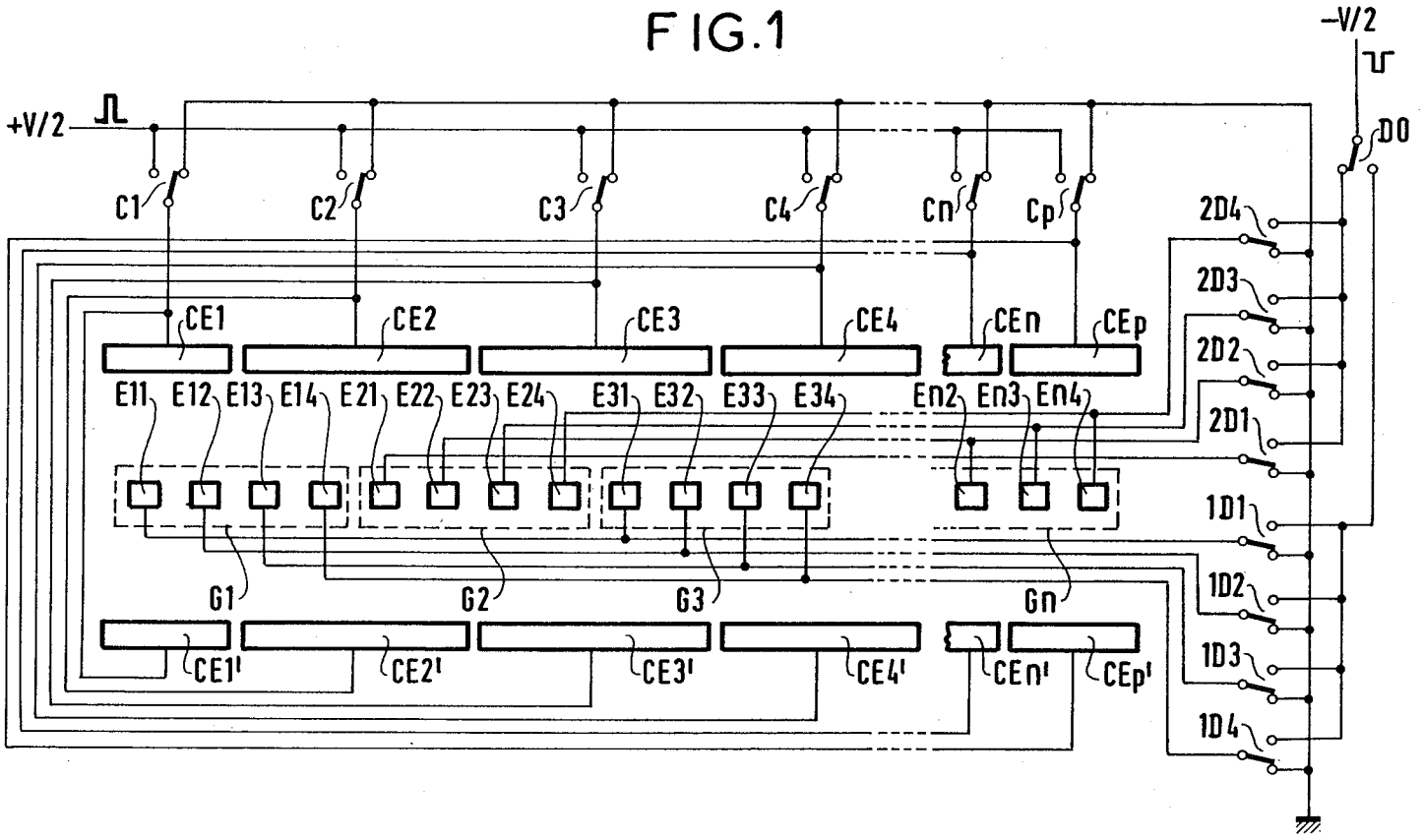
FIG. 1 is a diagram showing the respective positions of the electrodes and the counterelectrodes in an electrostatic print head having its electrodes and counterelectrodes situated on the same side of the recording medium, the figure also shows their control connections.

In conventional manner, for example as described in European published patent application No. 0 124 856, an electrostatic print head generally comprises a plurality of electrodes E aligned along at least one row having at least one (and in this case having two) rows of counterelectrodes CE running adjacent thereto. FIG. 1 shows the rows of electrodes and the rows of counterelectrodes seen active end on.

As mentioned above, the electrodes and the accompanying counterelectrodes are intended to be placed against or very close to the same side of an image recording medium which is in the form of a strip.

There are very many electrodes E, for example there may be 1728 such electrodes, and they are divided into n groups arranged in two networks with each group preferably having the same number r of electrodes, for example there may be 36 groups with 48 electrodes per group. In FIG. 1, the number of electrodes per group, r is shown as being equal to four, in order to simplify the figure.

In the simplified embodiment shown, the electrodes E occupying the same position within each of the various groups of either network are interconnected, for example electrodes E13 and E33 are interconnected as are electrodes E23 and En3. Within each network electrodes are put under voltage by means of switches such as 1D or 2D, each of which serves a set of interconnected electrodes. For example, the switch 1D3 serves the electrodes E13 and E33 given by way of example above.

Each of the switches D normally applies a zero voltage to the electrodes to which it is connected, other than when specifically controlled to apply a voltage to its electrodes for printing purposes. When printing is to be performed by one of the electrodes connected to a switch 1D or 2D, the corresponding switch is actuated so as to bring the selected electrode and all other electrodes interconnected thereto to a high voltage potential $-V/2$, which potential is smaller in magnitude than the threshold high voltage potential V required for printing by ion discharge, and in this case it is equal to one-half of the threshold value.

The counterelectrodes CE disposed on either side of the electrodes E are arranged in this case in $p=n+1$ groups of pairs of interconnected counterelectrodes occupying the same positions along the line of electrodes. For example counter-electrodes CE1 and CE1' together constitute one such pair of interconnected counterelectrodes, and both of them are situated at the same end position but on opposite sides of the row of electrodes.

The counterelectrodes CE other than the end counter-electrodes CE1, CE1' to Cp, and Cp' each overlap two successive groups of electrodes. For example, the pair of counter-electrodes CE2, CE2' overlap the electrodes E13 and E14 of the group 1 and the electrodes E21 and E22 of the group 2.

The counter electrodes are put under voltage by means of switches C which are referenced C1 to Cp, with each switch being connected to both counterelectrodes of a corresponding interconnected pair, for example the switch C1 is connected to the pair of counterelectrodes CE1, and CE1'. A zero voltage 0V is normally applied by each of the switches C to its associated pair of counterelectrodes, in the absence of a specific printing control signal being applied thereto. However, when a printing control signal is applied to a switch C, it then applies a high voltage potential of $+V/2$ to its associated counterelectrodes.

Printing ion discharge is thus obtained by putting an electrode to the potential $-V/2$ and putting the counter-electrodes running alongside to a potential of $+V/2$.

Figure 2:
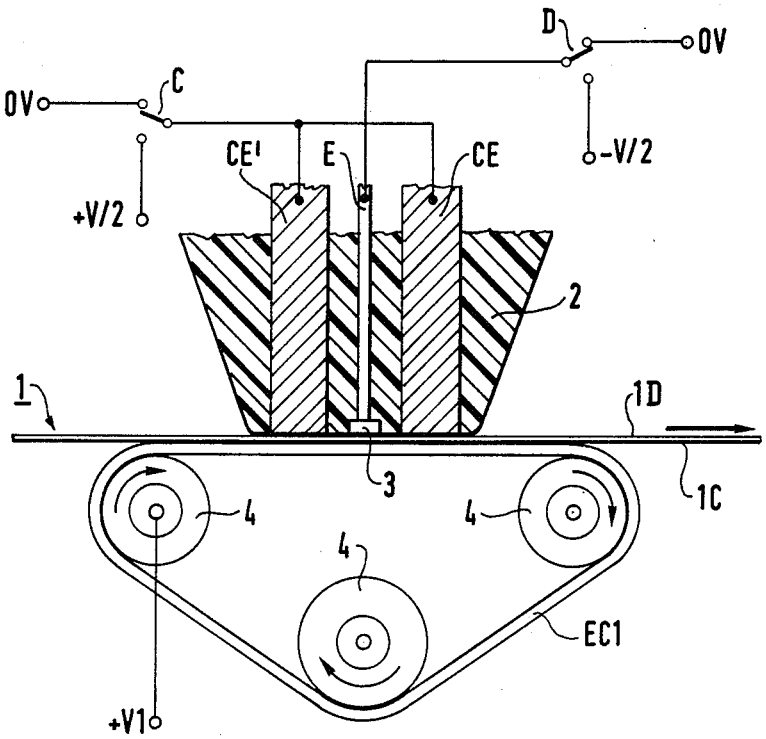
FIGS. 2 and 3 are cross-sections through first and second different electrostatic print heads in accordance with the invention.

This suffices if the recording medium 1 is of the type including a conductive layer 1C covered by a dielectric layer 1D against which the set of electrodes and counterelectrodes is pressed in order to apply point charges thereto, with the conductive layer serving as the lowest resistance path for ion discharge between any electrodes E and the adjacent counter-electrodes CE and CE', via the dielectric layer (see FIG. 2).

However, this does not suffice if the recording medium 1 is a thin insulating film used as an intermediate medium for forming latent images for subsequent transfer to a final medium, which is generally constituted by ordinary paper.

In accordance with the invention, a rotary coupling electrode EC (such as the electrode EC1 in FIG. 2) is provided and is connected to a DC potential V1 having the same polarity as the control pulses applied to the counter-electrodes, in order to associate its effect with the effect of the counterelectrodes, when selected.

The DC potential $+V1$ is selected to be much less than $+V/2$ so as to avoid triggering ion discharge between the coupling electrode and an unwanted electrode E, for example the coupling electrode may be at a potential of one hundred to two hundred and fifty volts for an ion discharge potential V of about five to six hundred volts.

The coupling electrode EC is disposed transversely across the direction of recording medium displacement and covers the entire set of electrodes E and counterelectrodes CE, and extends beyond the ends of the rows of electrodes and counter-electrodes which are themselves also naturally disposed transversely relative to the direction of recording medium displacement. The electrodes and the counterelectrodes are embedded in a block of insulating material 2 which holds them in position relative to one another.

Given that the recording medium is generally constituted by a very smooth thin film, a small air gap 3 is generally provided between the electrodes and the recording medium, and this gap is usually obtained by means of groove running along the block 2 over the tips of the electrodes E.

In the embodiment shown in FIG. 2, the coupling electrode EC1 is constituted by an endless belt of flexible resistive material, for example conductor-impregnated elastomer, and its resistivity may be about $10^6$ to $10^7$ ohm. centimeters, for example. This strip electrode runs freely around carrier rolls 4 (three in this case) which keep it under tension and two of which press it against the recording medium 1 in the vicinity of the ends of the electrodes and the counterelectrodes. The coupling electrode EC1 is raised to a potential $+V1$ for example by suitably connecting one of the carrier rolls to a source of potential via a conventional slip ring and brush arrangement. The assembly comprising the block 2, the rolls 4, and the coupling electrode EC1 is mechanically held in a conventional support frame (not shown) which is not described in greater detail herein since such a structure is of no direct bearing on the present invention.

Figure 3:
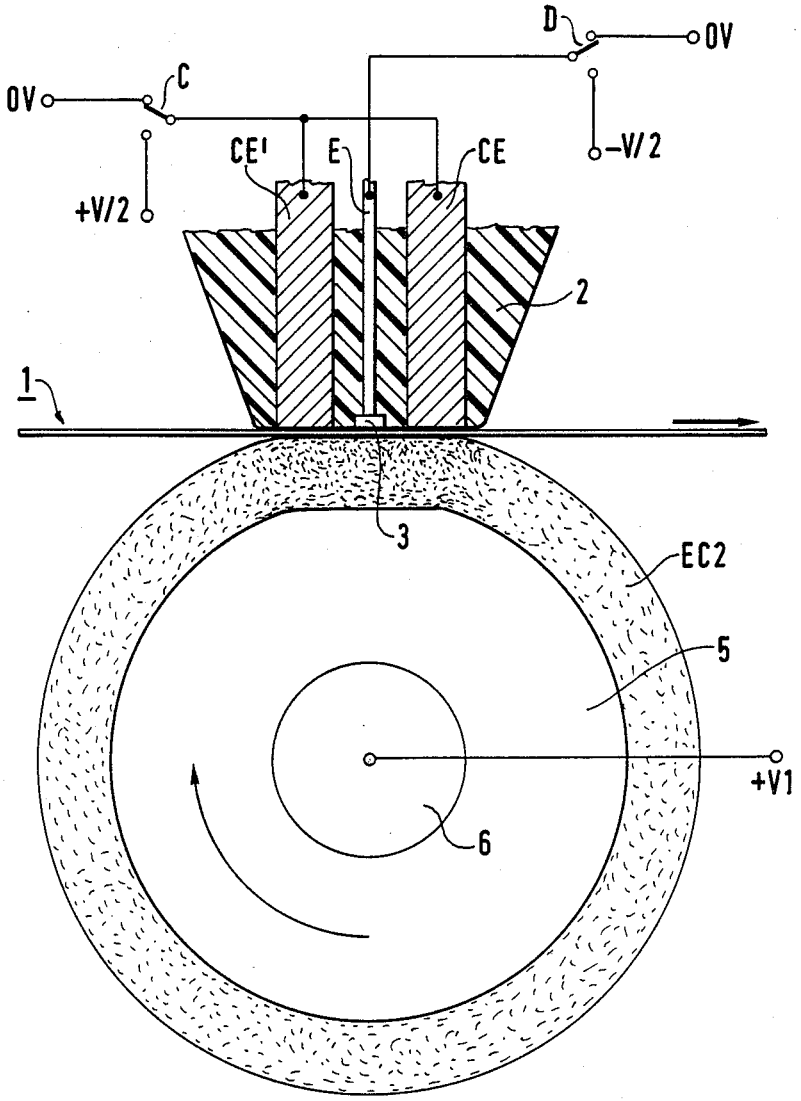

In the embodiment shown in FIG. 3, the endless belt coupling electrode EC1 is replaced by a cylindrical coupling electrode EC2.

The cylindrical coupling electrode EC2 is disposed transversely to the direction of recording medium displacement and is constituted by a tube of flexible material having a hardness of less than thirty on the Shore scale and a diameter of about six centimeters.

The flexible tube is, for example, made of elastomer material having a resistivity of about $10^6$ to about $10^7$ ohm. centimeters. In the variant shown in FIG. 3, the flexible tube 5 is mounted free to rotate on a shaft 6 and is covered with an outer layer of constant thickness (lying in the range 0.1 mm to several mm) having the required resistivity and connected to the potential +V1, for example by means of slip ring system associated with the tube and a fixed brush or shoe (not shown here since highly conventional).

The coupling electrode EC2 is pressed mechanically (for example by a system of springs) against the assembly constituted by the electrodes, the counterelectrodes and the portion of the block 2 which contains their tips, so that the coupling electrode is deformed thereagainst under said pressure so as to cover said electrodes and said counterelectrodes.

The recording medium which rubs against the coupling electrode EC1 or EC2 during the recording of latent images serves to drive said electrode which is generally mounted to rotate freely. Naturally, the coupling electrode could be driven to rotate by any suitable conventional means, thereby substantially totally reducing the friction between the recording medium and the coupling electrode.

Naturally a print head as defined above for printing on an ordinary medium after the electrostatic latent image has been inked and after the inked image has been transferred onto the final medium (if required) can also be used to print on special composite paper including a dielectric layer and a conductive layer.

What is claimed is:

1. An electrostatic print head comprising firstly at least one row of individual electrodes disposed at a regular pitch and organized into n groups which are shared between two different networks, with the electrodes occupying the same positions in the various groups of a given network being interconnected, and secondly at least one set of counterelectrodes running parallel to the individual electrodes and each attributed to at least one group of the adjacent electrodes in such a manner as to create a latent image on a dielectric recording medium running over said electrodes and said counterelectrodes by ion discharge between at least one of said electrodes and at least one of said counterelectrodes respectively raised to high voltage potentials of opposite polarity by high voltage control pulses, the electrostatic print head including the improvement of a rotary coupling electrode made of a conductive material and raised to a direct potential of average voltage having the same polarity as the high voltage pulses applied to the counterelectrodes, said coupling electrode being pressed against the recording medium level with the electrodes and the counterelectrodes and on the opposite face of the recording medium to said electrodes and counterelectrodes.

2. An electrostatic print head according to claim 1, wherein the rotary coupling electrode is constituted by an endless belt of flexible conductive material mounted on rotary shafts disposed transversely relative to the recording medium so as to be pressed thereagainst over a zone which extends opposite the electrodes and the counterelectrodes, and on either side thereof.

3. An electrostatic pring head according to claim 1, wherein the rotary coupling electrode is constituted by a cylinder of resistive elastomer material mounted on a rotary shaft disposed transversely to the recording medium and in such a manner as to be partially pressed thereagainst in a zone extending opposite the electrodes and the counter electrodes and on either side thereof.

4. An electrostatic print head according to claim 1, wherein the rotary coupling electrode is constituted by a coating of resistive elastomer covering a cylinder of flexible insulating material which is mounted on a rotary shaft disposed transversely to the recording medium so as to be pressed thereagainst in a zone opposite the electrodes and the counter-electrodes and on either side thereof.

* * * * *